US007467991B2

(12) United States Patent
McCowen et al.

(10) Patent No.: US 7,467,991 B2
(45) Date of Patent: Dec. 23, 2008

(54) KNIFE SHARPENER

(75) Inventors: Steven A. McCowen, Iola, WI (US); Charles Kain, Indianapolis, IN (US)

(73) Assignee: GB II Corporation, Tualatin, OR (US)

( * ) Notice: Subject to any disclaimer, the term of this patent is extended or adjusted under 35 U.S.C. 154(b) by 0 days.

(21) Appl. No.: 11/256,537

(22) Filed: Oct. 21, 2005

(65) Prior Publication Data

US 2006/0141916 A1 Jun. 29, 2006

Related U.S. Application Data

(60) Provisional application No. 60/621,329, filed on Oct. 22, 2004.

(51) Int. Cl.
*B24B 23/00* (2006.01)

(52) U.S. Cl. ..... 451/349; 451/347; 451/524; 451/555

(58) Field of Classification Search ..... 451/349, 451/347, 524, 555, 45, 523; 76/82.2, 83, 76/84, 88, 89.1
See application file for complete search history.

(56) References Cited

U.S. PATENT DOCUMENTS

| | | | | | |
|---|---|---|---|---|---|
| 690,172 | A | | 12/1901 | Montgomery | |
| 1,075,690 | A | * | 10/1913 | Buck | 451/555 |
| 1,100,418 | A | * | 6/1914 | Christopherson | 76/88 |
| 1,158,048 | A | * | 10/1915 | Hawks | 76/88 |
| 1,181,161 | A | * | 5/1916 | Perry | 451/555 |
| 1,223,127 | A | | 4/1917 | Walker | |
| 1,496,728 | A | * | 6/1924 | Olson | 451/511 |
| 1,909,743 | A | | 5/1933 | Blankner | |
| 1,957,278 | A | * | 5/1934 | Ling | 451/232 |
| 2,652,667 | A | * | 9/1953 | Arnold | 451/555 |
| 2,674,072 | A | | 4/1954 | Lohmann | |
| 2,753,670 | A | * | 7/1956 | Carapucci | 451/419 |
| 2,896,482 | A | * | 7/1959 | Hyde | 76/84 |
| 3,280,514 | A | | 10/1966 | Raymond | |
| 3,894,362 | A | | 7/1975 | Graves | |
| 4,090,418 | A | * | 5/1978 | Ishida | 76/84 |
| 4,197,677 | A | | 4/1980 | Graves | |
| 4,231,194 | A | | 11/1980 | Glesser | |

(Continued)

OTHER PUBLICATIONS

Website, Lansky Sharpeners, www.lansky.com/products/crock.html, 2 pages, publication date unknown.

(Continued)

*Primary Examiner*—Joseph J. Hail, III
*Assistant Examiner*—Robert Scruggs
(74) *Attorney, Agent, or Firm*—Klarquist Sparkman, LLP

(57) ABSTRACT

The present disclosure concerns embodiments of an improved knife sharpener. In particular embodiments, the knife sharpener has an elongated sharpening member, which can be, for example, an abrasive sharpening rod. The sharpening rod can be made of any of various suitable materials, such as ceramic, porcelain, stone, diamond. The sharpening member extends through a sharpening guide, which is movable in both directions along the length of the sharpening member. The sharpening guide defines at least one guide slot for receiving a knife blade to be sharpened. The guide slot is configured to position a facet of the knife blade in sliding contact with the sharpening member and at a predetermined angle with respect to the sharpening member.

27 Claims, 5 Drawing Sheets

U.S. PATENT DOCUMENTS

| | | | | | |
|---|---|---|---|---|---|
| 4,502,254 | A | * | 3/1985 | Carter | 451/555 |
| 4,538,382 | A | * | 9/1985 | Johannsen | 451/175 |
| 4,640,058 | A | | 2/1987 | Glesser | |
| 4,716,689 | A | * | 1/1988 | Friel | 451/45 |
| 4,751,795 | A | | 6/1988 | Jenne | |
| 4,799,335 | A | * | 1/1989 | Battocchi | 451/241 |
| 4,912,885 | A | | 4/1990 | Bonapace | |
| 4,928,343 | A | * | 5/1990 | Kissinger | 15/229.3 |
| D316,662 | S | | 5/1991 | Cherniak | |
| 5,046,385 | A | * | 9/1991 | Cozzini et al. | 76/89.2 |
| D328,847 | S | | 8/1992 | Button et al. | |
| 5,189,848 | A | * | 3/1993 | Flaherty | 451/45 |
| 5,363,602 | A | | 11/1994 | Anthon et al. | |
| 5,390,431 | A | | 2/1995 | Friel | |
| 5,431,070 | A | * | 7/1995 | Thames | 76/88 |
| 5,461,785 | A | * | 10/1995 | Sol Na | 30/138 |
| 5,547,419 | A | * | 8/1996 | Hulnicki | 451/321 |
| 5,586,647 | A | * | 12/1996 | Barta et al. | 206/217 |
| D410,185 | S | | 5/1999 | Huber | |
| 5,954,571 | A | * | 9/1999 | Case | 451/354 |
| 6,048,262 | A | | 4/2000 | Ray | |
| 6,059,645 | A | | 5/2000 | LeVine | |
| 6,168,509 | B1 | | 1/2001 | Presgrove | |
| 6,393,946 | B1 | * | 5/2002 | Kenesky et al. | 76/86 |
| 6,547,656 | B1 | | 4/2003 | LeVine | |
| 6,711,791 | B2 | | 3/2004 | Hess | |
| 6,752,702 | B1 | | 6/2004 | Thompson et al. | |
| 6,769,327 | B2 | | 8/2004 | Henry | |
| 6,817,269 | B1 | * | 11/2004 | Grace, Jr. | 76/86 |
| 6,881,137 | B2 | * | 4/2005 | Friel, Sr. | 451/344 |
| 2002/0094768 | A1 | | 7/2002 | Friel | |
| 2002/0144410 | A1 | | 10/2002 | Hufnagel | |
| 2003/0150121 | A1 | | 8/2003 | Jebe | |
| 2004/0198198 | A1 | | 10/2004 | Friel, Sr. et al. | |
| 2005/0250428 | A1 | * | 11/2005 | Friel et al. | 451/349 |
| 2006/0276110 | A1 | | 12/2006 | Friel, Sr. et al. | |

OTHER PUBLICATIONS

Website, The Knife Professional, Lansky Sharpeners Knife Clamp, www.knifepro.com/products.asp?ProdID=1006348ctgID=, 1 page, publication date unknown.

Statement by Rodney L. Bremer, dated Mar. 24, 2007 (2 pages).

* cited by examiner

KNIFE SHARPENER

CROSS-REFERENCE TO RELATED APPLICATION

The present application claims the benefit of U.S. Provisional Application No. 60/621,329, filed Oct. 22, 2004, which is incorporated herein by reference.

FIELD

The present disclosure relates generally to devices for sharpening knife blades.

BACKGROUND

Many of the wide variety of knife sharpeners that have been developed in the past fail to give truly sharp edges or even consistently good edges because of the lack of good angular control during the sharpening process. This is particularly true of "V-type" sharpeners intended to sharpen both edge facets simultaneously. Manual means for sharpening in particular are unsatisfactory because existing V-type sharpeners do not have an integral control of the angle but depend on the user to hold the blade vertically with respect to the sharpening surfaces while sharpening. To develop a really sharp edge it is important that the blades pass over the abrasive surface stroke after stroke at the same angle.

A common V-type sharpener is the crock stick sharpener, which typically includes a pair of ceramic rods that are crossed to form a V-shaped slot. The rods usually are made of abrasive material such as sintered aluminum oxide. In use, the knife edge is pulled through the crotch formed by the two rods. Unfortunately, there is no angular control and any rotational motion of the blade (deviation from vertical) or any tilting of the blade horizontally stroke to stroke will substantially reduce the chances of getting a sharp edge on the blade.

Another V-type sharpener uses a series of flat individual rectangular abrasive bars to form a V slot, but again there is no provision for angular control of the blade as it is pulled through the sharpener. This, like other V-type sharpeners, requires a skillful operator to hold the blade "vertical" during sharpening, which is an impractical requirement. Any angular variation stroke to stroke will result in reforming each of the blade facets at a new and different angle. This tends to dull the edge and possibly deform it, rather than sharpen it to a keen edge.

Thus, there is exists much room for improvement in the prior art.

SUMMARY

The present disclosure concerns embodiments of an improved knife sharpener. According to one embodiment, the knife sharpener has an elongated sharpening member, which can be, for example, an abrasive sharpening rod. The sharpening rod can be made of any of various suitable materials, such as ceramic, porcelain, stone, and/or diamond. The sharpening member extends through a sharpening guide, which is movable in both directions along the length of the sharpening member. The sharpening guide desirably is made of a low-friction material, such as nylon, high-density polyethylene or similar polymers, to facilitate sliding of the sharpening guide relative to the sharpening member. The sharpening guide defines at least one guide slot for receiving a knife blade to be sharpened. The guide slot is configured to position a facet (i.e., one side of the blade edge) of the knife blade in sliding contact with the sharpening member and at a predetermined angle with respect to the sharpening member.

To sharpen the knife blade, the user draws the blade through the guide slot while moving the sharpening guide and the blade in the direction of the length of the guide. As the blade slides laterally and longitudinally across the sharpening surface during a sharpening stroke, the blade is held at the predetermined angle with respect to the sharpening member by the guide. Notably, the guide slot also aligns the blade at the same angle on each successive stroke to ensure a sharp blade.

In particular embodiments, a biasing member, such as a coil spring, is coupled to the sharpening guide. The biasing member resiliently urges the sharpening guide to a rest position. When sharpening a blade, the sharpening guide is moved along the length of the sharpening member against the biasing force of the biasing member. At the end of the stroke, the user reduces hand pressure on the blade to allow the sharpening guide to move back to the rest position under the force of the biasing member.

In certain embodiments, a knife sharpening kits includes multiple sharpening members of different grades of coarseness and multiple sharpening guides that are useable with any of the sharpening members. The sharpening guides are provided with guide slots that are inclined at different angles to accommodate different types of blades.

In another embodiment, a knife sharpening apparatus includes a case or housing and a knife sharpener pivotably connected to the housing. The sharpener desirably includes an elongated sharpening member and an elongated support rod extending from a rotatable base disposed in the housing. The sharpening member and the support rod are pivotable together between a down position inside the housing for storage and a generally upright position extending from the housing for use in sharpening a blade. A sharpening guide is slidably disposed on the sharpening member and has a guide slot for positioning a blade at a predetermined angle with respect to the sharpening member and in sliding contact with the sharpening member. The support rod extends through a groove formed in the sharpening guide to limit rotation of the sharpening guide while permitting sliding of the sharpening guide along the length of the sharpening member.

The housing can include storage space for one or more removable sharpening guides having different pre-set sharpening angles. The housing also can include a lid for mounting a flat sharpening stone that can be used to sharpen knife blades and other tools in a conventional manner.

The foregoing and other features and advantages of the invention will become more apparent from the following detailed description of several embodiments, which proceeds with reference to the accompanying figures.

DETAILED DESCRIPTION

As used herein, the singular forms "a," "an," and "the" refer to one or more than one, unless the context clearly dictates otherwise.

As used herein, the term "includes" means "comprises."

As used herein, the term "knife" can include any cutting device or utensil having at least one cutting blade, which may be fixed, foldable or partially or wholly retractable relative to a handle or grip. Examples of cutting devices and utensils included within the term "knife" include, without limitation, kitchen knives, butcher's knives, chefs knives, sporting knives, box cutters knives, pocket knives, letter openers or bodkins, and the like.

Figure 1:
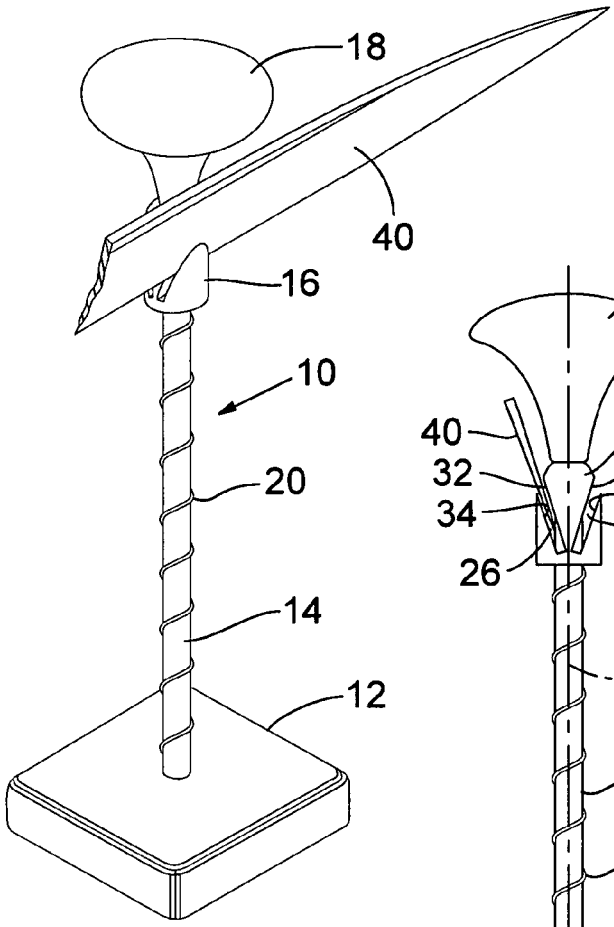
FIG. 1 is a perspective view of a knife sharpener, according to one embodiment, shown with a knife blade in the sharpening guide of the knife sharpener, and the guide being shown in a rest position at the beginning of a stroke.
Figure 2:
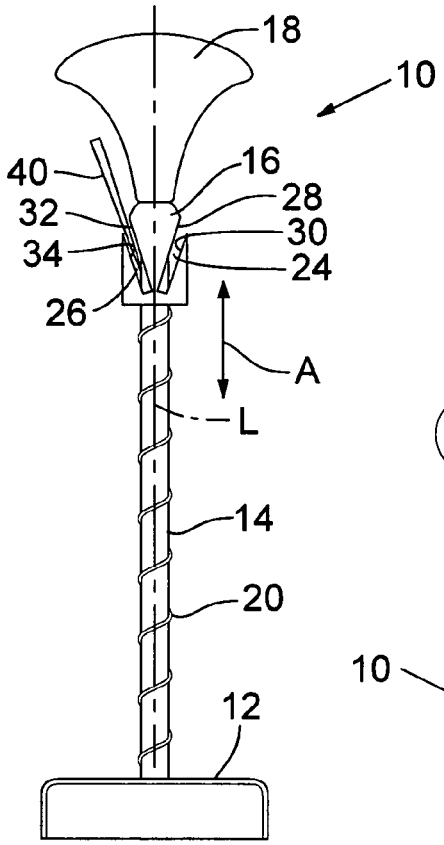
FIG. 2 is an elevation view of the knife sharpener shown in FIG. 1.

Referring first to FIGS. 1 and 2, there is shown a knife sharpener 10, according to one embodiment. The knife sharpener 10 in the illustrated embodiment includes a base 12, an elongated sharpening member 14 coupled to and extending upwardly from the base 12, a sharpening guide 16 (also referred to herein as a blade guide), a cap 18 mounted at the top of the sharpening member 14, and a biasing member in the form of a coil spring 20 disposed around the sharpening member 14 between the base 12 and the sharpening guide 16.

The sharpening member 14 desirably comprises a hard, abrasive material, such as ceramic, porcelain, stone, diamond, or any of various other suitable materials. The sharpening member can be made entirely of an abrasive material. Alternatively, the sharpening member can have an inner core (which can be a non-abrasive material) and an outer layer of abrasive material overlaying the core.

The sharpening member 14 in the illustrated configuration is an elongated rod, which can be generally cylindrical as shown, or can have other cross-sectional profiles, such as a square, rectangular, oval, ellipse, or combinations thereof. In a specific implementation, the rod can be generally cylindrical with one or more flat sharpening surfaces extending the majority of the length of the rod.

The sharpening member 14 can be mounted on the base by inserting the lower end portion into an aperture (not shown) in the base. Similarly, the cap 18 can be mounted on the sharpening member 14 by inserting the upper end portion of the sharpening member into an aperture (not shown) in the lower surface of the cap. The sharpening member desirably is removable from the base 12, the cap 18, and the sharpening guide 16 so that another sharpening member that is more or less coarse can be used and/or a different sharpening guide can be used. In particular embodiments, for example, an assembly or kit includes two or more similarly shaped sharpening members of different grades of coarseness. The kit also can include different sharpening guides configured to accommodate different blade thicknesses or blade angles, as further described below.

In alternative embodiments, the cap and/or the base can be permanently mounted to the sharpening member.

The sharpening member 14 extends through a central opening 22 (FIG. 4) in the sharpening guide 16. The sharpening guide 16 is movable in first and second, opposing directions relative to the sharpening member 14 (upwardly and downwardly in the illustrated embodiment) along the longitudinal axis L of the sharpening member, as indicated by double-headed arrow A (FIG. 2). The sharpening guide 16 functions to align and maintain a knife blade 40 (FIGS. 1-3) at a predetermined, acute angle with respect to the sharpening member during sharpening.

Figure 4:
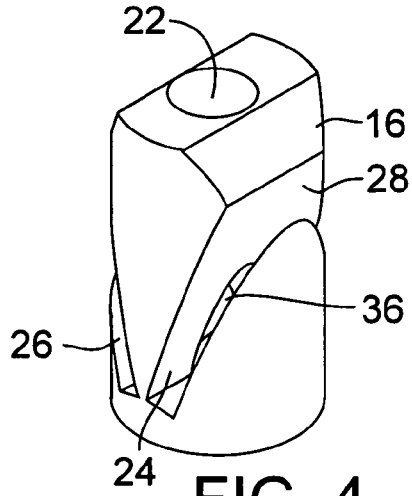
FIG. 4 is an enlarged, perspective view of the sharpening guide shown in FIG. 1.

As best shown in FIGS. 2 and 4, the illustrated sharpening guide 16 is formed with first and second, diametrically opposed guide slots 24 and 26, respectively, for receiving the knife blade 40 (FIG. 4). The first guide slot 24 has an upper guide surface 28 spaced from a lower guide surface 30. Likewise, the second guide slot 26 has an upper guide surface 32 spaced from a lower guide surface 34. The guide surfaces 28, 30 and 32, 34 are inclined at a predetermined angle with respect to the sharpening member 14, which determines the angle between the knife blade 40 and the sharpening member 14 during sharpening. In alternative embodiments, the sharpening guide 16 can be provided with only one guide slot.

While the illustrated embodiment shows the guide surfaces of the slots 24, 26 as being generally parallel, this is not a requirement. For example, a guide slot can be slightly tapered from the top of the slot to the bottom of the slot to correspond to the taper of a knife blade.

As shown in FIG. 4, the sharpening guide 16 is formed with an opening 36 extending from the central opening 22 (FIG. 4) to the upper surface 28 of the first guide slot 24. A similar opening (not shown) extends from the central opening 22 to the upper surface 32 of the second guide slot 26. In this manner, a portion of the sharpening member 14 is exposed in each guide slot 24, 26 for contacting the knife blade 40 (as best shown in FIG. 2). Thus, when the knife blade 40 is placed in one of the guide slots for sharpening, one facet of the cutting edge is placed in sliding contact with the sharpening member 14. The guide surfaces of the guide slot align the blade at the same angle with respect to the sharpening member on each successive stroke to ensure a sharp edge.

The incline of the guide slot with respect to the sharpening member can vary depending on the type of knife to be sharpened. In certain embodiments, the incline of the guide slot is in the range from about 15 degrees to about 25 degrees, although greater or smaller angles also can be used. As mentioned above, the sharpening guide 16 desirably is removable from the sharpening member 14. As such, a set of two or more sharpening guides having guide slots oriented at different angles can be provided. In one embodiment, for example, a set of sharpening guides includes a first sharpening guide having guide slots inclined at about 15 degrees with respect to the sharpening member and a second sharpening guide having guide slots inclined at about 20 degrees with respect to the sharpening member. The first sharpening guide can be used, for example, for knives having relatively finer cutting edges, such as pocket knives. The second sharpening guide can be used, for example, for hardier knives, such as choppers.

The width of the gap between the guide surfaces of a slot 24, 26 desirably is slightly greater than the thickness of the blade to be sharpened so that the surfaces of the guide slot contact the opposing surfaces of the blade. To accommodate blades of varying thicknesses, a set of sharpening guides can include multiple sharpening guides of the same sharpening angle but different gap widths. Alternatively, each sharpening guide can have a first set of guide slots and a second set of guide slots formed below the first set of guide slots. In this alternative configuration, the first and second sets of guide slots can have the same sharpening angle but different gap widths. In a more sophisticated embodiment, a sharpening guide can be configured to vary the gap width between guide surfaces. For example, a portion of the sharpening guide can be movable to vary the gap width between the guide surfaces. The movable portion can be spring loaded to maintain a minimum gap width and increase the gap width upon insertion of a knife blade.

Figure 3:
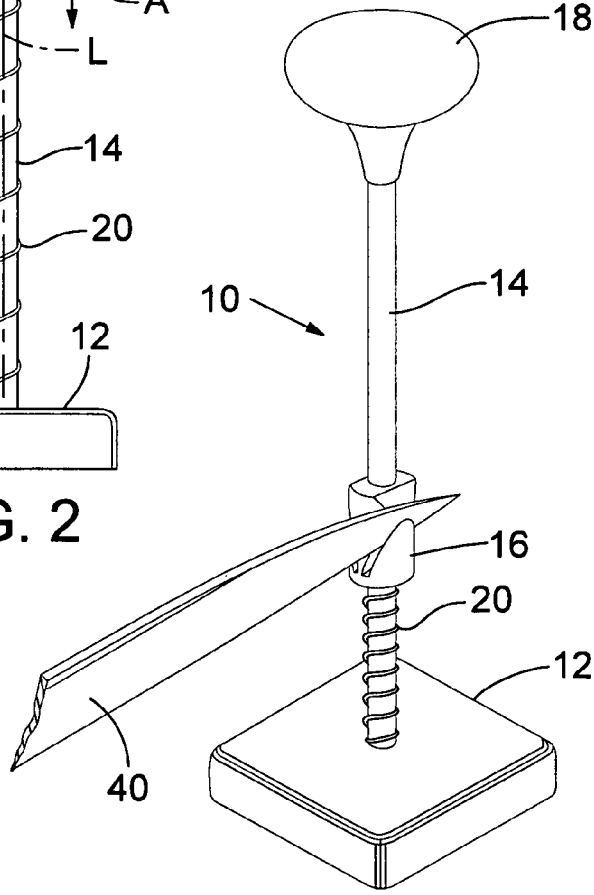
FIG. 3 is a perspective view of the knife sharpener of FIG. 1 showing the knife at the end of a stroke.

When at rest, the spring 20 resiliently urges the sharpening guide 16 to an initial or rest position adjacent the cap 18 (as shown in FIGS. 1-3). As mentioned above, the spring 20 is disposed between the guide 16 and the base 12, which serves as a stop or retainer for retaining the spring on the sharpening member 14. Alternatively, an extension spring can be connected to the cap 18 and the top of the guide 16 so as to pull the guide upwardly to the rest position. Additionally, biasing members other than springs can be used to bias the sharpening guide to the rest position, such as an elastic band connected to the cap 18 and the top of the guide 16.

At the beginning of a sharpening stroke, the handle end of the blade 40 is positioned in one of the guide slots of the sharpening guide 16 such that a facet of the cutting edge contacts the sharpening member 14 (FIG. 1). The blade 14 is then drawn laterally through the guide slot toward the user and downwardly against the force of the spring 20 until the length of the blade has been stroked across the surface of the sharpening member 14 (FIG. 3). Alternatively, if the tip of the blade is positioned in the sharpening guide at the beginning of the stroke, the knife is pushed through the guide slot away from the user and downwardly relative to the sharpening member. In any event, as the knife blade is moved across and down, the blade can be maintained at the same angle relative to the sharpening member 14. When the blade is removed from the sharpening guide at the end of the stroke, the spring 20 returns the sharpening guide to its rest position. To sharpen the other facet of the cutting edge, the blade is placed in the opposite slot and drawn rearwardly and downwardly in the same manner. This process can be repeated until the blade has obtained the desired sharpness. Because the guide slots orient the blade at the same angle on each successive stroke, the blade is sharpened to a keen edge.

Another approach for sharpening the blade 40 is as follows. With the sharpening guide at its rest position, the blade is drawn rearwardly and downwardly until just the tip of the blade remains in the sharpening guide. At this point, hand pressure on the blade is lightened to allow the spring 20 to lift the sharpening back to its rest position while the blade is pushed forwardly through the guide slot to ready the blade for another stroke. This sequence can be repeated as necessary, after which the blade is positioned in the opposite guide slot to sharpen the other facet of the blade in the same manner. After the majority of the length of the blade is sharpened, the tip of the blade can be sharpened in one or more short strokes.

In a less sophisticated embodiment, a fixed or stationary sharpening guide can be retained at a fixed position on a sharpener member. In this embodiment, the sharpening guide aligns the blade at a predetermined angle with respect to the sharpening member as the blade is stroked laterally across the sharpening member, but does not allow any longitudinal movement of the blade relative to the sharpening guide.

Figure 5:
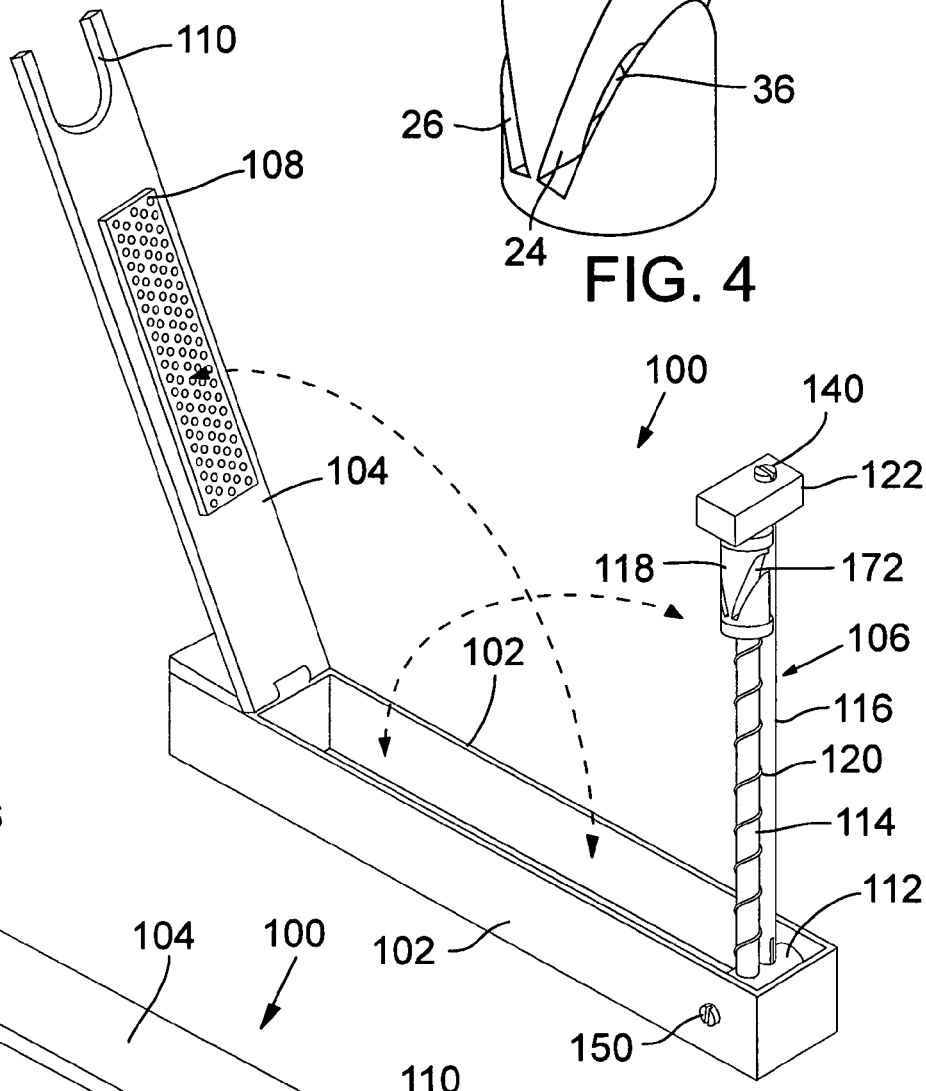
FIG. 5 is a perspective view of a knife sharpening apparatus, according to another embodiment, having a case, a first sharpener shown in its upright, useable position extending from the case and a second sharpener mounted on the inside surface of the lid of the case.
Figure 6:
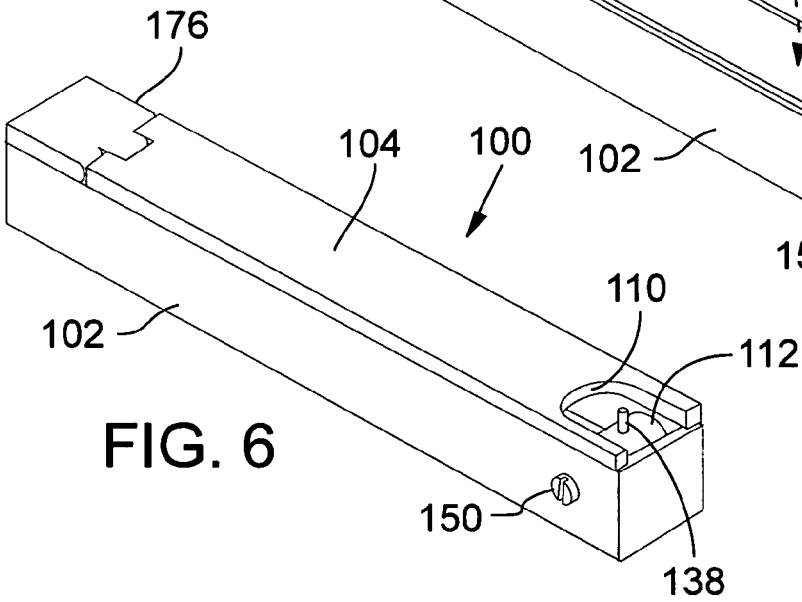
FIG. 6 is a perspective view of the apparatus of FIG. 5, showing the first and second sharpener in a folded down position inside the case for storage.

FIGS. 5-11 illustrate a knife sharpening apparatus 100, according to another embodiment. As shown in FIG. 5, the knife sharpening apparatus 100 generally includes a generally rectangular case, or housing, 102, a pivotable lid 104, and a knife sharpener 106 pivotably coupled to the case 102. The knife sharpener 106 can be pivoted between an upright, useable position extending upwardly from the case 102 (as shown in FIG. 5) and a folded down position inside the case for storage (as shown in FIG. 6).

The lid 104 is connected to the case 102 by a pivot pin (not shown) so that the lid can be pivoted between a down position covering the upper opening of the case (FIG. 6) and an open position (FIG. 5) to allow the sharpener 106 to be rotated to its upright position for sharpening a knife blade. As shown in FIG. 5, a sharpening stone 108 can be mounted to the inside surface of the lid 104. The sharpening stone 108 can be used for touching up blade tips or sharpening other tools in a conventional manner. The lid 104 can be formed with a notched end portion 110 that is sized to permit the lid to be folded down to its closed position around the sharpener while the sharpener 106 is in its upright position.

The sharpener 106 in the illustrated configuration generally comprises a rotatable base 112 mounted in the case 102, an elongated sharpening member 114 (e.g., an abrasive rod) extending from the base 112, a support rod 116 extending from the base 112 in generally parallel relationship with the sharpening member 114, a sharpening guide 118 slidably disposed on the sharpening member 114, a coil spring 120 disposed on the sharpening member 114 between the sharpening guide 118 and the base 112, and a cap, or end piece, 122 mounted to the ends of the sharpening member 114 and the support rod 116.

In the illustrated embodiment, the upper end portion of the sharpening member 114 extends into a similarly shaped opening (not shown) in the bottom of the end piece 122. The end piece 122 can be secured in place by a screw 140 extending through an opening 142 in the end piece and tightened into a threaded opening 144 in the upper end portion of the support rod 116 (FIG. 9).

Figure 7:
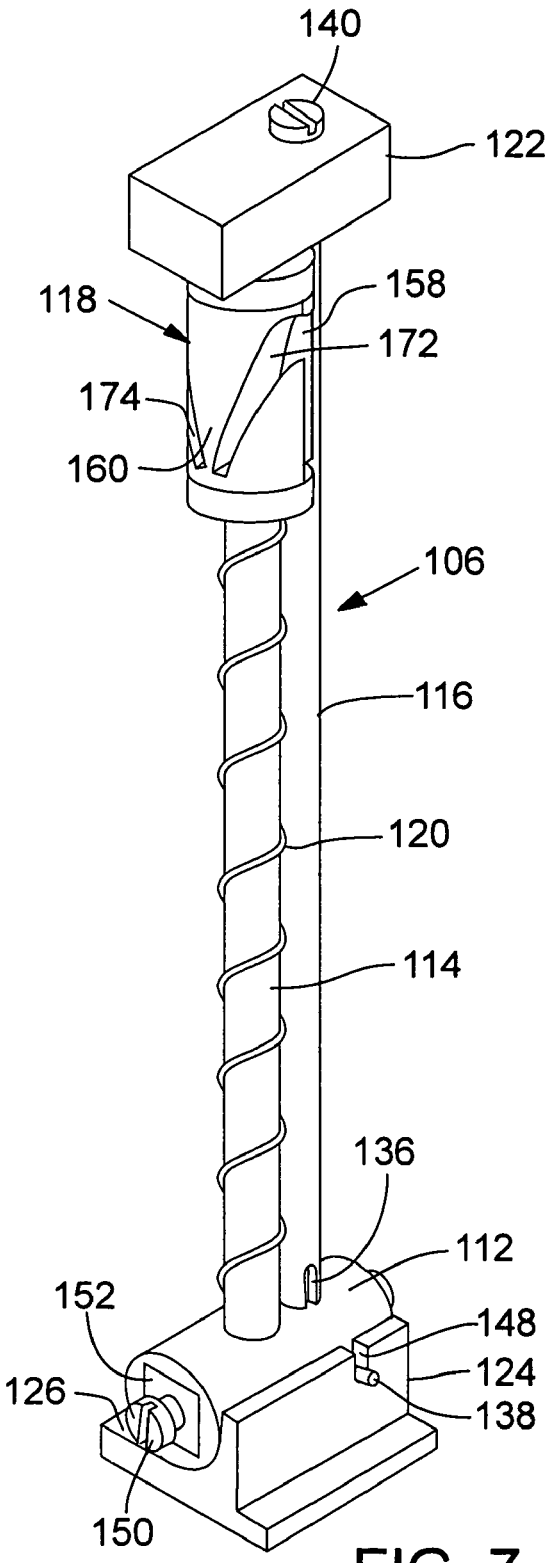
FIG. 7 is a perspective view of first sharpener of FIG. 5, shown removed from the case for clarity.
Figure 8:
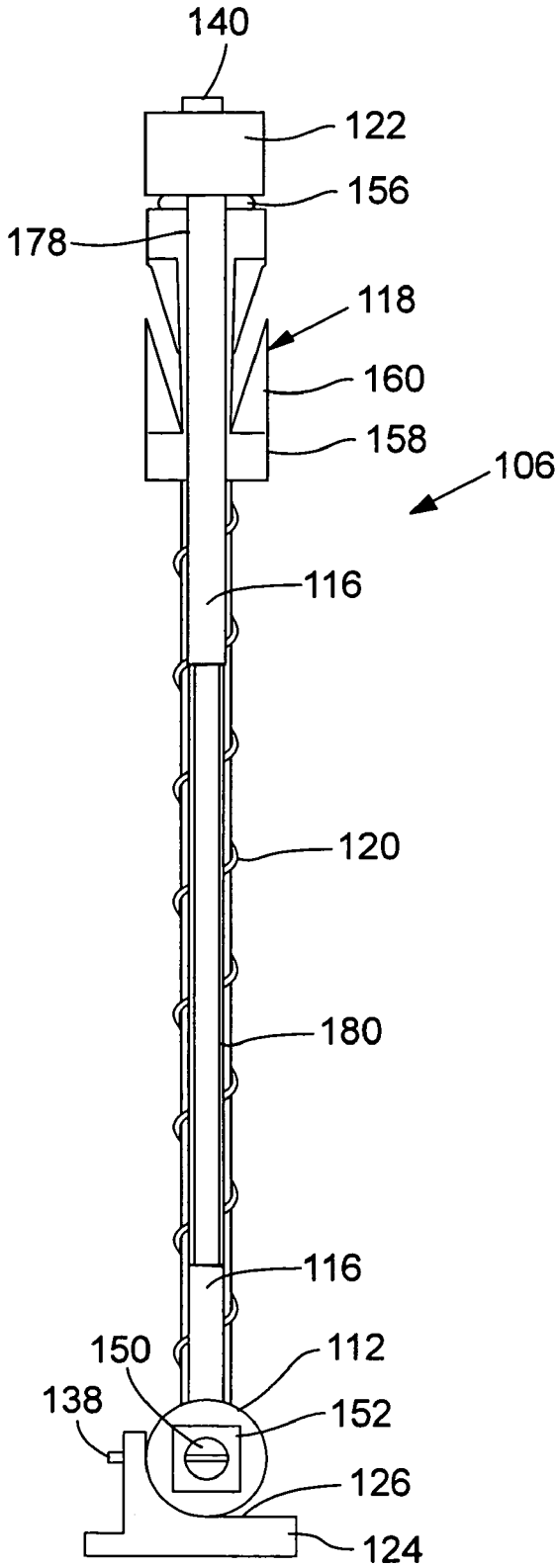
FIG. 8 is a rear elevation view of the first sharpener shown in FIG. 7.
Figure 9:
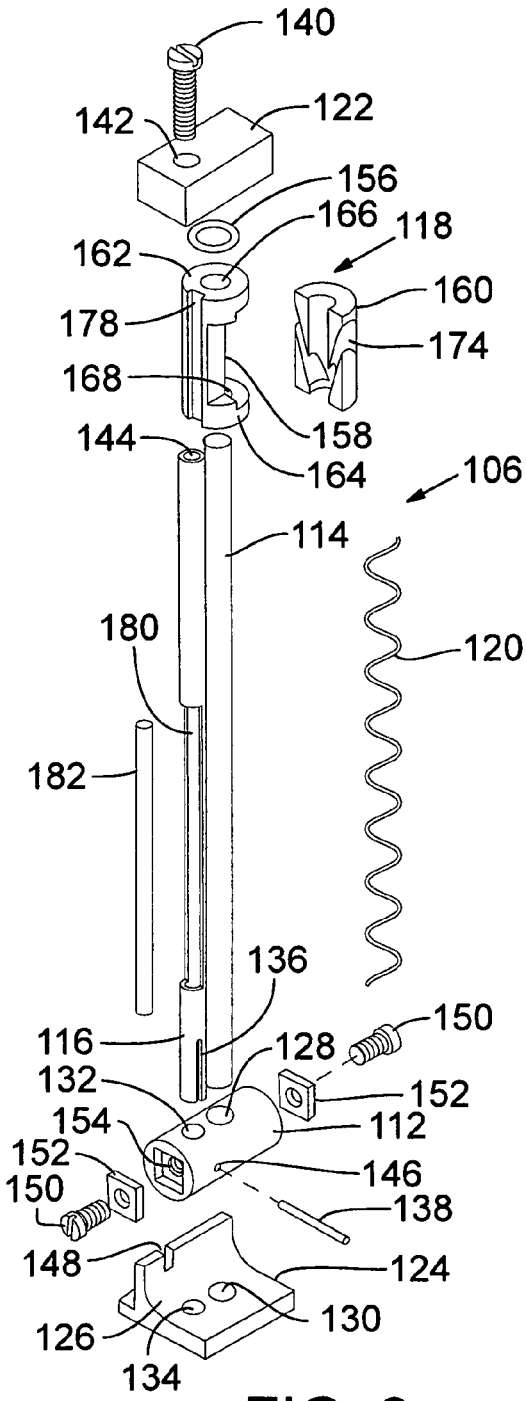
FIG. 9 is a perspective, exploded view of the first sharpener shown in FIG. 7.
Figure 10:
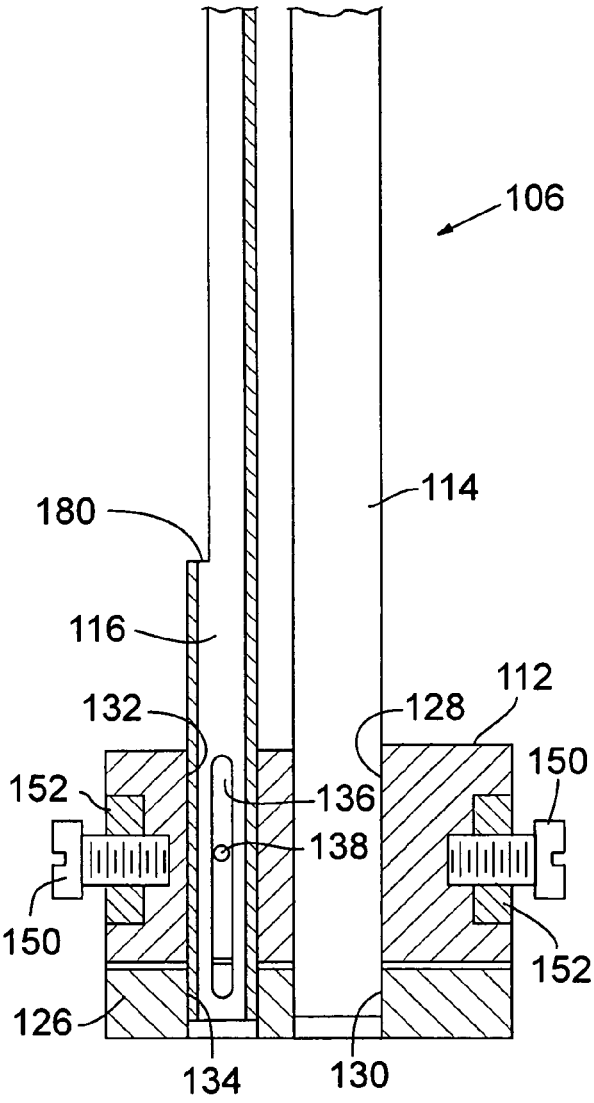
FIG. 10 is an enlarged, fragmentary sectional view of the first sharpener shown in FIG. 7.

As shown in FIGS. 7-9, the illustrated base 112 is generally cylindrical and desirably is supported on a support 124 disposed in the case 102. The support 124 desirably is formed with a curved upper surface 126 that generally conforms to the curvature of the base 112. As best shown in FIGS. 9 and 10, the base 112 is formed with a through opening 128 and the support 124 is formed with a corresponding opening 130 to slidably receive the lower end portion of the sharpening member 114. Similarly, the base 112 is formed with a through opening 132 and the support is formed with a corresponding opening 134 to slidably receive the lower end portion of the support rod 116. A pin 138 extends through an opening 146 (FIG. 9) in the base 112 and an elongated slot 136 formed in the support rod 116 to retain the components together in their assembled form. As best shown in FIG. 7, the pin 138 desirably is dimensioned to extend into a notch 148 formed in the support 124, which serves as a stop to limit upward pivoting of the sharpener. Desirably, the notch 148 is configured to engage the pin 138 and prevent further pivoting of the sharpener when it is generally perpendicular to the case as shown.

The support 124 can be retained in the case 102 using any techniques or mechanisms, such as by securing the support with an adhesive or a mechanical fastener (e.g., a screw). The base 112 in the illustrated embodiment is secured to the case 102 by screws 150. Referring to FIGS. 5 and 9, each screw 150 extends through an opening in a side panel of the case 102, a nut 152 retained in a recess at one end of the base 112, and a threaded opening 154 in the base 112. The screws 150 desirably are tightened to a degree sufficient to permit the sharpener to pivot upwardly and downwardly about a pivot axis defined by the screws.

When the sharpener 106 is pivoted to the upright position, the sharpening member 114 and the support rod 116 can be inserted into respective openings 130, 134 in the support 124 to prevent rotation of the base, thereby locking the sharpener in place for use (as best shown in FIG. 10). The pin 138 and the notch 148 facilitate this process by preventing further pivoting of the sharpener when sharpening member and the support rod are aligned above the openings 30, 134. To pivot the sharpener 106 to the down position inside the case 102, the sharpening member 114 and the support rod 116 are lifted upwardly until their lower ends clear (i.e., are lifted above) the openings 130, 134 in the support 124. This can be accomplished by simply pulling upwardly on the end piece 22. As can be appreciated, the pin 138 prevents the sharpening member 114 and the support rod 116 from being completely removed from the base 112. Once the sharpening member and the support rod are lifted above the respective openings 130, 134, the sharpener 106 can be pivoted downwardly into the case.

Like the embodiment shown in FIGS. 1-5, the sharpening guide 118 is slidable in both directions along the longitudinal axis of the sharpening member 114, and the spring 120 applies a biasing force that retains the sharpening guide 118 in an initial or rest position, as shown in FIGS. 5, 7 and 8, when downward pressure from a user is not applied to the guide. As best shown in FIGS. 8 and 9, an o-ring 156 can be positioned between the end piece 122 and the sharpening guide 118 to cushion upward movement of the sharpening guide against the end piece.

Figure 11:
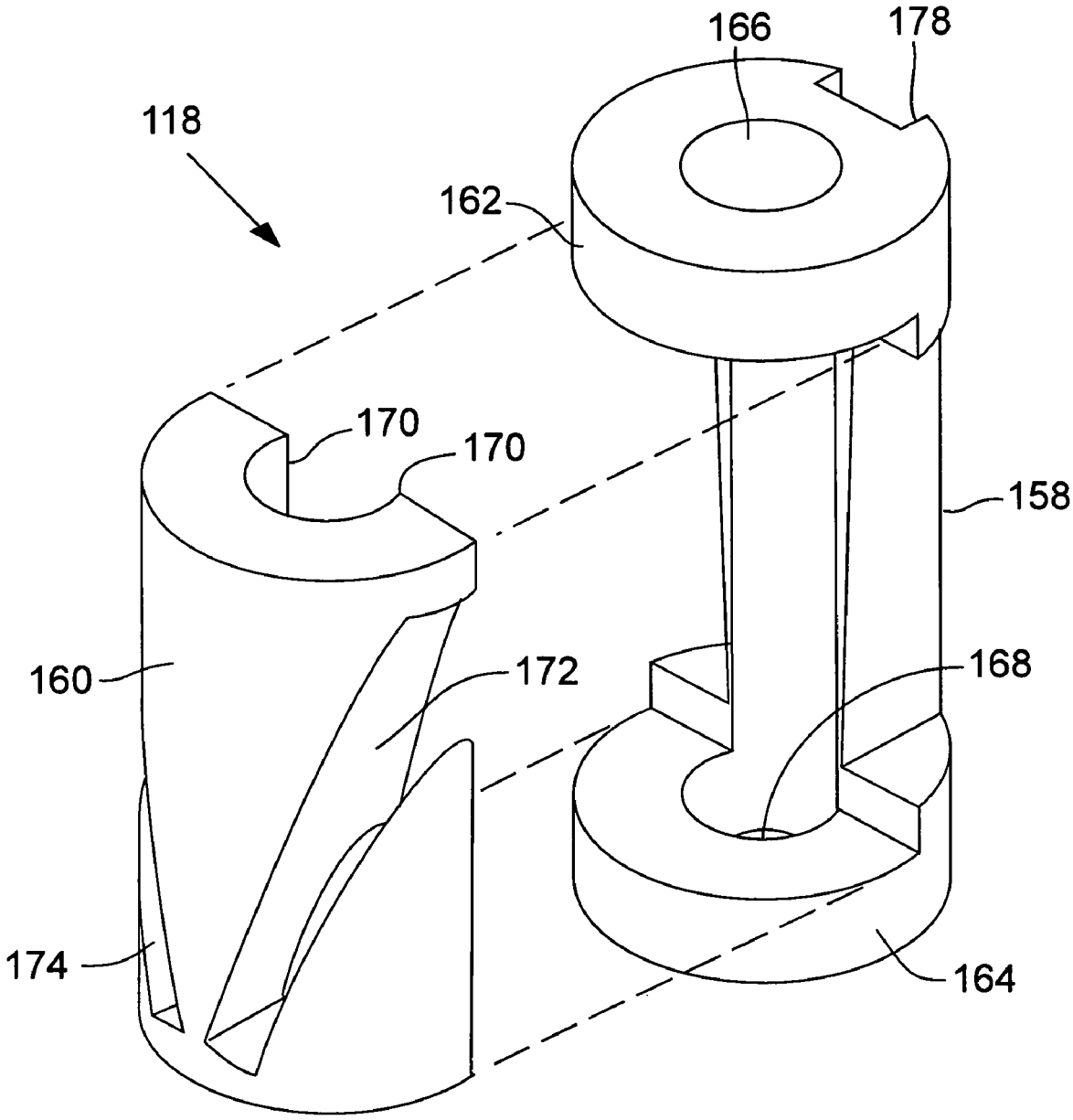
FIG. 11 is an enlarged, perspective, exploded view of the sharpening guide of the first sharpener shown in FIG. 7.

As best shown in FIGS. 9 and 11, the illustrated sharpening guide 118 comprises a sliding portion 158 slidably disposed on the sharpening member 114 (FIG. 9) and a removable guide portion 160 secured to the sliding portion 158. The sliding portion 158 is formed with a first, upper end portion 162 spaced from a second, lower end portion 164, between which the guide portion 160 is inserted. The sharpening member 114 extends through openings 166, 168 formed in the end portions 162, 164, respectively.

The guide portion 160 desirably is sufficiently resilient form a "snap-fit" connection with sharpening member to retain the guide portion 160 in place between the end portions 162, 164 of the sliding portion 158 during use. As used herein, a "snap-fit" connection means a releasable connection between two bodies having opposing surfaces, which connection is formed by resiliently deforming at least one of the bodies so as to allow the opposing surfaces to be placed in an interlocking relationship with each other. To connect the guide portion 160, the guide portion is positioned against the sharpening member 114 between the end portions 162, 164 of the sliding portion 158. Sufficient pressure is then applied to the guide portion to cause the guide portion to deform slightly and allow opposing edges 170 (FIG. 11) to slide over the surface of the sharpening member until the edges 170 disengage from the surface of the sharpening member, allowing the guide portion to return to its normal shape. The guide portion 160 can be easily removed from the sharpening member by pulling or separating the guide portion away from the sharpening member with sufficient force to cause the guide portion to deform and allow edges 170 to slide over the surface of the sharpening member.

Guide slots 172 and 174 for a receiving a knife blade (e.g., knife blade 40 shown in FIGS. 1-3) are formed in the guide portion 160. Like the guide slots 24, 26 of the sharpener 10 (FIGS. 1-4), the guide slots 172, 174 are configured to position a blade in sliding contact with the sharpening member 114 and maintain a predetermined angle between the blade and sharpening member during sharpening. The incline of the guide slots 172, 174 can vary depending on the particular blade to be sharpened. Because the guide portion 160 can be removed from the sliding portion 158, a set or kit of multiple guide portions can be provided to accommodate blades of different thicknesses or different facet angles. The case 102 in the illustrated embodiment is sized to provide space for storing multiple guide portions 160. As shown in FIG. 6, a separate lid 176 can be provided to access to the storage compartment for the guide portions.

As best shown in FIG. 9, the sliding portion 158 is formed with an elongated slot, or groove, 178 extending the length of the sliding portion and sized to loosely receive the support rod 116. In this manner, the sliding portion 158 can slide freely relative to the support rod, but cannot rotate freely about the sharpening member 114, thereby providing better control during sharpening.

The sharpener 106 can be used to sharpen knife blades in the manner described above in connection with the sharpener 10 (FIGS. 1-4). In addition, as further shown in FIG. 9, the support rod 116 can be formed with a recess 180 that is sized to receive a sharpening stone 182. The sharpening stone 182 can be used, for example, for sharpening serrated edges.

The present invention has been shown in the described embodiments for illustrative purposes only. The present invention may be subject to many modifications and changes without departing from the spirit or essential characteristics thereof. We therefore claim as our invention all such modifications as come within the spirit and scope of the following claims.

We claim:

1. An apparatus for sharpening a blade of a knife, comprising:

an elongated sharpening member comprising an elongated rod having an outer sharpening surface extending along the length thereof;

a sharpening guide comprising a body and an opening extending through the body, the sharpening member extending through the opening, the sharpening guide being movable longitudinally relative to the sharpening member from a rest position to another position longitudinally spaced from the rest position, the sharpening guide having a slot for receiving the blade, the slot extending at a fixed, acute angle with respect to the sharpener surface and configured to position the blade at said acute angle with respect to the sharpener surface and such that at least a portion of the blade can contact the sharpening surface, wherein when the blade can move laterally in the slot and the sharpening guide can move longitudinally relative to the sharpening member, the blade can slidably contact the sharpening surface as it is moved laterally and longitudinally across the sharpening surface; and a biasing member configured to move the sharpening guide from said another position back to the rest position in a direction parallel to the length of the sharpening member.

2. The apparatus of claim 1, wherein the slot of the sharpening guide comprises a first slot and the sharpening guide also has a second slot configured to position the blade at said acute angle with respect to the sharpener surface, the first and second slots being positioned at opposite sides of the sharpening member from each other, wherein the first slot positions a first surface of the blade in contact with the sharpening surface and the second slot positions a second, opposing surface of the blade in contact with the sharpening surface.

3. The apparatus of claim 1, wherein the biasing member is a spring, the sharpening member extending coaxially through the spring.

4. The apparatus of claim 3, further comprising a base coupled to one end of the sharpening member and wherein the spring is positioned between the base and the sharpening guide to resiliently bias the sharpening guide away from the base.

5. The apparatus of claim 1, wherein the sharpening member comprises an abrasive rod.

6. The apparatus of claim 1, wherein the body completely surrounds the opening and the sharpening member extends generally co-axially through the opening.

7. The apparatus of claim 1, wherein the slot comprises two generally parallel guide surfaces extending at said acute angle with respect to the sharpening surface.

8. The apparatus of claim 7, wherein the blade can contact the sharpening surface through an opening defined in one of the guide surfaces.

9. The apparatus of claim 1, wherein the body of the sharpening guide comprises a first portion slidably disposed on the sharpening member and a second portion coupled to and movable with the first portion and defining the slot for receiving the blade, wherein the second portion is separable from the first portion.

10. The apparatus of claim 1, wherein:

the sharpening guide comprises a first sharpening guide that is removable from the sharpening member, the first sharpening guide defining the slot; and the apparatus further comprises a second, removable sharpening guide having a slot defining a width that is different than the slot of the first sharpening guide.

11. The apparatus of claim 1, further comprising a housing for the sharpening member and the sharpening guide, the sharpening member being pivotably coupled to the housing and operable to pivot between a first, upright position extending from the housing for sharpening the blade and a second, down position inside the housing for storage.

12. The apparatus of claim 11, wherein the housing comprises a lid adapted to cover an open top of the housing when the sharpening guide and the sharpening member are inside the housing, and further comprising a sharpening stone mounted to the lid.

13. The apparatus of claim 1, further comprising a support rod extending in a generally parallel relationship with the sharpening member, the support rod extending through a groove in the sharpening guide so as to limit rotation of the sharpening guide relative to the sharpening member.

14. The apparatus of claim 13, wherein the support rod defines a recess extending along a portion of the length of the rod and further comprising a sharpening stone disposed in the recess.

15. An apparatus for sharpening a blade of a knife, comprising:

an elongated sharpening member defining a sharpening surface; and a sharpening guide coupled to the sharpening member and being movable longitudinally relative to the sharpening member, the sharpening guide having a slot for receiving the blade, the slot configured to position the blade at an acute angle with respect to the sharpener surface and such that at least a portion of the blade can contact the sharpening surface, wherein when the blade can move laterally in the slot and the sharpening guide can move longitudinally relative to the sharpening member, the blade can slidably contact the sharpening surface as it is moved laterally and longitudinally across the sharpening surface;

wherein the sharpening guide comprises a first portion slidably disposed on the sharpening member and a second portion coupled to and movable with the first portion and having two opposing surfaces defining the slot therebetween for receiving the blade, wherein the second portion is separable from the first portion;

wherein the second portion of the sharpening guide is configured to form a snap-fit connection around the sharpening member.

16. An apparatus for sharpening a blade of a knife, comprising:

an elongated sharpening member defining a sharpening surface;

a sharpening guide coupled to the sharpening member and being movable longitudinally relative to the sharpening member, the sharpening guide having two opposing surfaces defining a slot therebetween for receiving the blade, the slot configured to position the blade at an acute angle with respect to the sharpener surface and such that at least a portion of the blade can contact the sharpening surface, wherein when the blade can move laterally in the slot and the sharpening guide can move longitudinally relative to the sharpening member, the blade can slidably contact the sharpening surface as it is moved laterally and longitudinally across the sharpening surface;

wherein:

the sharpening guide comprises a first sharpening guide and the acute angle comprises a first acute angle, the first sharpening guide being removable from the sharpening member; and the apparatus further comprises a second, removable sharpening guide having two opposing surfaces defining a slot therebetween configured to position the blade at a second acute angle, different than the first acute angle, with respect to the sharpener surface.

17. An apparatus for sharpening the blade of a knife, comprising:

an elongated sharpening member defining a sharpening surface extending along the length of the sharpening member, the sharpening surface defining a longitudinal axis; and a sharpening guide coupled to the sharpening member and comprising a guide slot configured to align the blade such that at least a portion of the blade can make sliding contact with the sharpening surface at an acute angle relative to the longitudinal axis when the blade is placed in the guide slot;

the sharpening guide being movable longitudinally in first and second, opposing directions relative to the sharpening member, the first and second directions extending parallel to the longitudinal axis of the sharpening surface; and a biasing member that provides a biasing force to resiliently urge the sharpening guide in the first direction;

wherein when the blade is moved laterally through the guide slot and the sharpening guide is moved in the second direction against the biasing force of the biasing member, the blade slidably contacts the sharpening surface as it moves laterally and longitudinally across the sharpening surface, and when the blade is removed from the sharpening guide, the biasing member moves the sharpening guide in the first direction.

18. The apparatus of claim 17, wherein the biasing member comprises a coil spring disposed around the sharpening member between the sharpening guide and a stop coupled to the sharpening member, the sharpening member extending coaxially through the coil spring.

19. The apparatus of claim 17, wherein:

the sharpening member comprises a first sharpening member and the sharpening guide is removable from the sharpening member; and the apparatus further comprises a second sharpening member that has a sharpening surface that is coarser than the sharpening surface of the first sharpening member, wherein the sharpening guide can be used with the second sharpening member to provide coarser sharpening of the blade.

20. The apparatus of claim 17, wherein the sharpening member comprises an elongated rod.

21. The apparatus of claim 17, wherein the acute angle is in the range of about 15 degrees to about 25 degrees.

22. The apparatus of claim 17, wherein the sharpening member comprises an elongated rod and the sharpening surface is an outer surface of the rod and extends along the length thereof.

23. An apparatus for sharpening the blade of a knife, comprising:

a sharpening rod;

guide means for maintaining the blade at a predetermined, acute angle with respect to the sharpening rod as a user moves the blade across the sharpening rod;

wherein the sharpening rod extends through the guide means, and the guide means comprises a first slot and a second slot positioned on diametrically opposing sides of the rod, the first slot being configured to position a first surface of the blade in contact with the rod and the second slot being configured to position a second, opposing surface of the blade in contact with the rod;

wherein the guide means is movable longitudinally relative to the sharpening rod from a rest position to another position spaced from the rest position to allow the user to move the blade laterally and longitudinally across the sharpening surface; and biasing means for providing pressure against the guide means for moving the guide means from the another position back to the rest position when hand pressure is removed from the guide means.

24. A method for sharpening the blade of a knife, comprising moving the blade through a first slot in a blade guide so as to maintain a first surface of the blade in sliding contact with a sharpening rod and at a predetermined, acute angle with respect to the sharpening rod while simultaneously moving the blade guide longitudinally of the sharpening rod from a rest position to another position spaced from the rest position, allowing the blade guide to move longitudinally along the sharpening rod from the another position back to the rest position under the force of a biasing member, and then moving the blade through a second slot in the blade guide so as to maintain a second, opposing surface of the blade in sliding contact with the sharpening rod at the predetermined acute angle while simultaneously moving the blade guide longitudinally of the sharpening rod.

25. A method for sharpening the blade of a knife, comprising sliding the blade in a first direction through a sharpening guide and against an abrasive surface while simultaneously moving the sharpening guide and the blade in a second direction, perpendicular to the first direction, relative to the abrasive surface from a first, rest position to a second position spaced from the rest position, and providing a biasing force against the sharpening guide in a third direction, opposite the second direction, wherein after the sharpening guide is moved to the second position, allowing the biasing force to move the sharpening guide from the second position back to the rest position.

26. The method of claim 25, wherein the abrasive surface is an abrasive rod and the sharpening guide maintains the blade at a predetermined, acute angle with respect to the rod as the sharpening guide moves in the direction of the longitudinal axis of the rod.

27. The method of claim 25, wherein the abrasive surface extends along the length of an elongated rod.

* * * * *